United States Patent [19]

Kawashima

[11] 4,103,884

[45] Aug. 1, 1978

[54] CLOTH ARTICLE TRANSPORTERS

[76] Inventor: Yoshiro Kawashima, 18 Higashikomazume-cho, Gifu City, Japan

[21] Appl. No.: 758,189

[22] Filed: Jan. 10, 1977

[51] Int. Cl.[2] ..... B65H 3/22

[52] U.S. Cl. ..... 271/18.3; 214/1 BB; 214/8.5 C; 214/658; 294/61

[58] Field of Search ..... 294/61; 214/658, 1 BB, 214/8.5 C; 271/18.3

[56] References Cited

U.S. PATENT DOCUMENTS 3,285,649 11/1966 Harton ..... 294/61

FOREIGN PATENT DOCUMENTS 977,119 12/1964 United Kingdom ..... 294/61

*Primary Examiner*—Albert J. Makay
*Assistant Examiner*—George F. Abraham

[57] ABSTRACT

A transporter for a cloth article comprises a body member adopted to be moved up and down. A pair of spaced plates is carried by the body member. Needle members extend downwardly from each of the plates and a first means moves the plates downwardly so that its associated needles can pierce a single cloth article placed thereunder. A second means moves the plates away from and towards each other and a third means moves the body member for selected upward and horizontal distances, respectively.

5 Claims, 6 Drawing Figures

CLOTH ARTICLE TRANSPORTERS

A prior application, now abandoned, relating to the same subject matter had been filed by the same inventor on June 25, 1972 under Ser. No. 156,666.

This invention relates to transporters for cloth articles and in particular to improved cloth article transporters for use in garment manufacturing operations requiring mass attachment of cloth article components.

In the usual garment manufacturing operations, pieces of cut and shaped cloth are precut in mass production for components such as pockets, sleeves, collars, etc. The mass production of such components mechanically produces a vertical stack or pile of such cloth articles. For the assembly of the entire cloth garment, a plurality of such piles of cloth component parts are placed around and near a central final assembly position. In the prior art, in order to complete the garment, an operator normally reaches out and takes off one cloth component from one of the component piles, places such components in a working position in front of her, reaches out and selects another cloth component from another pile of cloth articles and places that component in juxtaposition of first cloth article component and thereafter continues such operations until she has the required number of cloth article components in proper postion on the assembly surface. Thereafter the components are attached to one another, usually by sewing. According to this prior art method, the operator has to interrrupt her work each time to transport each cloth component from the various piles placed in front of her. The constant interruption of her work reduces the efficiency and output of the production. To supply the operator with handling personnel speeds up the production output, but the cost of such handling operations contributes greatly to high manufacturing costs.

The object of this invention is to reduce the cost of assembling a plurality of cloth article components at the assembly location.

As shown in the drawings wherein the same reference number is used for the same components in the various Figures.

Figure 1:
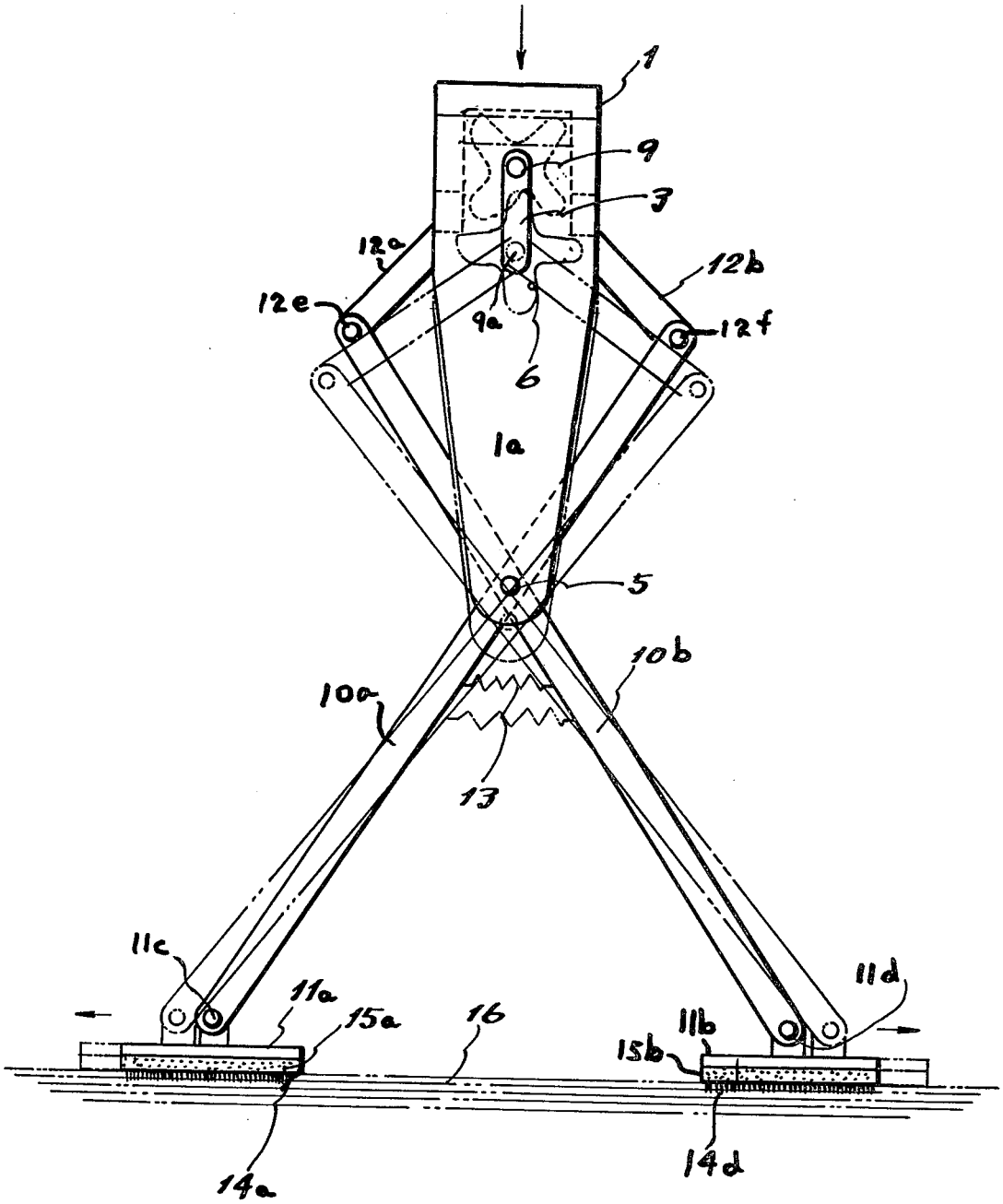
FIG. 1 is a front elevation of one embodiment of the invention.
Figure 2:
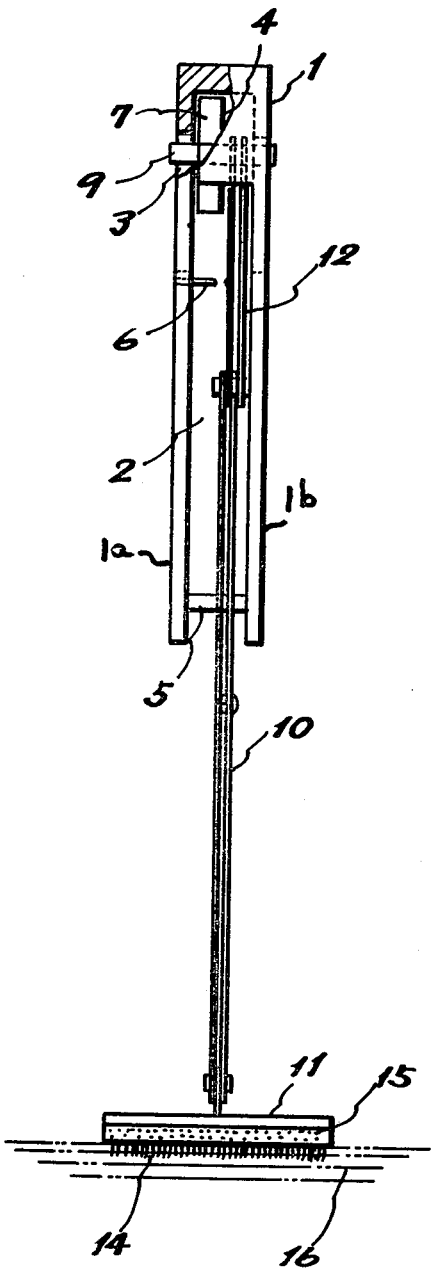
FIG. 2 is side elevation of the device of FIG. 1.
Figure 3:
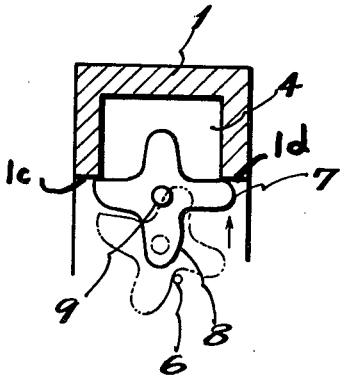
FIG. 3 shows the locked state of the cam of the device of FIGS. 1 and 2.
Figure 4:
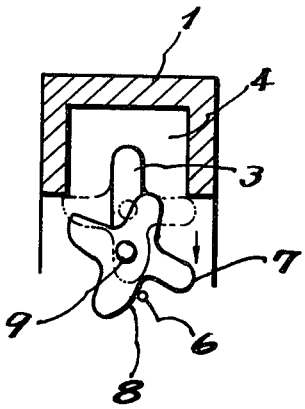
FIG. 4 shows the unlocked state of the cam of the device of FIGS. 1 and 2.

In FIGS. 1 to 4, a U-shaped body member 1 is movable in a up and down direction by known mechanisms (not shown in the drawings). Body member 1 has a space 2 between its U-shaped legs 1*a*, 1*b*. In each of the legs 1*a*, 1*b*, a vertical slot 3 is provided along the center lines thereof, the top of the slot 3 being spaced from the top of body member 1 so as to provide a cavity 4 for on the operation of a cam 7 (to be described later). A shaft 5 is supported by each of the lower portions of the spaced legs 1*a* and 1*b*. A cross-shaped cam 7 is mounted on an axle 9 which is slideably disposed in slot 3. A pin 6 is mounted in leg 1*a* so that it can engage one of the caming arms 8 of cam 7 so as to rotate the cam 7 when axle 9 is moved downwardly in slot 3. Axle 9 also rotatively mounts each of the ends of two struts 12*a* and 12*b*. Struts 12*a* and 12*b* are respectively pivotly mounted to one end of arms 10*a* and 10*b* by pins 12*e* and 12*f* respectively. Arms 10*a* and 10*b* are pivoted to a single pin 5 at an intermediate point along the lengths thereof. A pair of spaced transporter plates 11*a*, 11*b* are carried by the lower extremeties of arms 10*a* and 10*b* by pivots 11*c* and 11*d*. Needles 14 extend downwardly from the transporter plates 11*a* and 11*b* for a selective distance, so that they can pierce only one layer 16 of cloth components positioned under transporter plates 11*a* and 11*b*. A spring 13 is mounted between the arms 10*a*, 10*b* below the pivot 5 so that transporter plates 11*a* and 11*b* are normally at their minimum spaced distances as caused by shaft 9 being urged into its uppermost position in slot 3.

The device in FIGS. 1 to 4 is used as follows: When the body member 1 is moved vertically downward, needles 14*a* and 14*d* are impaled through only one flat piece in the cloth article pile positioned respectively under plates 11*a* and 11*b*. With the continuing downward movement of body member 1, pin 9 is urged downwardly to position 4*a* in slot 3 with the consequent spreading of arms 10*a*, 10*b* and thereby causing plates 11*a* and 11*b* to separate. Since needles 14*a* and 14*d* have been impaled through one cloth article piece, the movement of arms 10*a*, 10*b* slightly stretchs and grips the pierced cloth article. During the downward movement of axle 9 in slot 3, convex portion 8 of cam 7 is engaged by pin 6 to rotate cam 7 so that its outstretched arms engage shoulders 1*c* and 1*d* of body member 1 at the lower end of cavity 4. Accordingly, when the body member 1 is moved upwardly, the plates 11*a* and 11*b* remain separated and the impaled cloth article, as a consequence of its being stretched after being pierced, is held to plates 11*a* and 11*b*. Hence, when body member 1 is moved upwardly, the cloth piece 16 is carried upwardly with the plates 11*a* and 11*b*. The body member 1 can now be moved horizontally to a selected assembly position by known mechanisms (not shown) at which place body member 1 is moved downwardly. At that time, convex portion 8 of cam 7 again engages pin 6 to rotate cam 7 so that cam can slide into cavity 4 without any of its arms engaging shoulders 1*c* and 1*d*. This permits plates 11*a* and 11*b* to be moved toward each other by spring 13 at which time the impaled cloth article drops from needles 14*a* and 14*b* by gravity upon the selected assembly position therebeneath.

Figure 5:
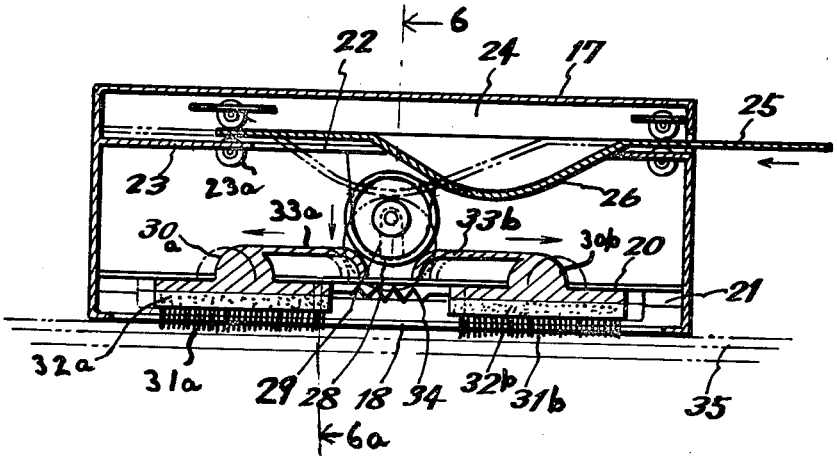
FIG. 5 is a cross sectioned view of another embodiment of the invention.
Figure 6:
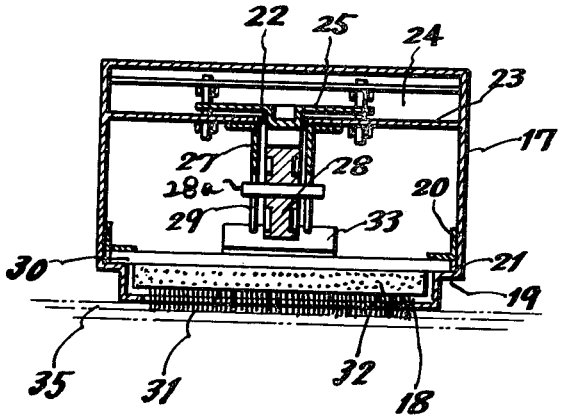
FIG. 6 is a sectional view taken along line 6-6*a* of FIG. 5.

Another embodiment of the invention is shown in FIGS. 5 and 6 wherein box body member 17 has an opening 18 in the bottom portion thereof. Box number 17 carriers L-shaped bars 20 at a selected distance above a carries portion 19 of the body member 17 so as to form a sliding groove 21 therebetween. A partition number 23 equipped with a notch 22 is placed at a selected distance from the top of body member 17 to form a sliding space 24. A slideable cam plate 25 having a convex surface 26 is slideably carried on partition 23 with the aid of rollers 23*a*. Convex portion 26 is disposed into a notch 22 of partition plate 23 and is engageable with a cam wheel 28 having an axle 28*a* slideably supported in a slot 29 of an angle support 27 carried by partition plate 23. Disposed below cam wheel 28 are two spaced camming surfaces 33*a* and 33*b* of two slideable plates 30*a* and 30*b* which support transporter plates 32*a* and 32*b* so that they can move horizontally away from and towards each other. Plates 30*a* and 30*b* are slideably supported by a partition 20 carried by body member 17. A spring 34 urges plates 32*a* and 32*b* together and plates 32*a* and 32*b* have extending downwardly therefrom needle members 31*a* and 31*b*.

The apparatus in FIGS. 5 and 6 operate as follows: The transporter 17 is placed over a pile of cloth articles so that its needles penetrate one layer 35 of a pile of cloth articles positioned thereunder. Cam plate 25 is then moved to the left which urges cam wheel 28 downwardly. Downward movement of wheel 28 engages and moves the caming surfaces 33*a* and 33*b* to separate plates 32*a* and 32*b* against the action of spring 18 attached therebetween. Accordingly, when the transporter 17 is moved in an upward direction, one cloth article piece is carried by needles 31*a* and 31*b* as a consequence of the elastic stretching of a single impaled cloth article by the needles 31*a* and 31*b*. When the transporter 17 is selectively moved in a horizontal movement to an assembly location the impaled cloth piece is released from needles 31*a* and 31*b* by a rightward movement of cam plate 25 which permits spring 18 to move plates 32*a* and 32*b* towards each other for releasing the impaled cloth piece.

While there has been described and pointed out the fundamental novel features of the invention as applied to a preferred embodiment, it will be understood that various omissions and substitutes and changes in the form and details of the devices illustrated and its operation may be made by those skilled in the art, without departing from the spirit of the invention. It is the intention, therefore, to be limited only as indicated by the scope of the following claims.

What I claim is:

1. A transporter for a cloth article which comprises a body member adapted to be moved up and down, a pair of spaced plates carried by said body member, a bias means to urge said pair of spaced plates towards each other, needle members extending downwardly from each of said plates, a first means for moving said body member downwardly so that the needles in the plates can pierce a cloth article placed thereunder, a second means for moving said plates away from each other, a locking means coupled to and actuated by said first means to arrest the inwardly displacement of said spaced plates upon a downward movement of said body member and upon the next downward movement of said body member to automatically release said spaced plates and allow said bias means to move said spaced plates together, and a third means for moving said body member for selected vertical and horizontal distances, respectively.

2. A transporter according to claim 1 wherein said second means moves said plates apart to grip said cloth article before said third means said body member for a selected upward distance and said locking means allows said plates to move together after said third means moves said body member for a selected downward distance.

3. A transporter according to claim 2 wherein said second means moves said plates apart so that their associated needle member selectively stretches said cloth article impaled between the needle members.

4. A transporter according to claim 1 wherein said body member includes a pair of pivoted struts, each plate being carried respectively by one end of each of said struts.

5. A transporter according to claim 1 wherein said locking means includes a cam rotatably reciprocally mounted for movement in said body member, means turning said cam upon successive downward movements of said body member, a shoulder depending from said body member which is engageable with a selected portion of said cam to alternatively arrest and release said spaced plates under the influence of said bias means.

* * * * *